United States Patent [19]

Godfrey et al.

[11] Patent Number: 4,513,469

[45] Date of Patent: Apr. 30, 1985

[54] RADIO CONTROLLED VACUUM CLEANER

[76] Inventors: James O. Godfrey; Robert E. Godfrey, both of 3612 Bali Dr., Sarasota, Fla. 33582

[21] Appl. No.: 503,771

[22] Filed: Jun. 13, 1983

[51] Int. Cl.[3] ..... A47L 9/28

[52] U.S. Cl. ..... 15/319; 15/339; 15/340; 180/167

[58] Field of Search ..... 15/319, 339, 340; 180/6.2, 19.3, 74, 167

[56] References Cited

U.S. PATENT DOCUMENTS

| | | | |
|---|---|---|---|
| 2,519,749 | 8/1950 | Edwards | 180/6.2 |
| 2,941,346 | 6/1960 | Perry | 180/6.2 X |
| 3,789,939 | 2/1974 | Geislinger | 15/319 X |
| 4,306,329 | 12/1981 | Yokoi | 15/339 X |
| 4,369,543 | 1/1983 | Chen et al. | 15/339 X |

*Primary Examiner*—Chris K. Moore

*Attorney, Agent, or Firm*—Hauke and Patalidis

[57] ABSTRACT

A remote controlled self-propelled vacuum cleaner comprising a manually held radio transmitter and a radio receiver installed in the vacuum cleaner. The vacuum cleaner is provided with a pair of freely rotating wheels driven by friction rollers on the ends of a driveshaft driven by an electric motor through an elastic belt. Each drive roller may be disengaged from the tire of the corresponding wheel by a solenoid operated lever. Lifting of a drive roller from a wheel tire causes the simultaneously application of a brake on the wheel such as to cause the vacuum cleaner to be steered in an appropriate direction. The electric motor is reversed for reversing the direction of motion of the vacuum cleaner. The steering solenoids and the direction of rotation of the electric motor are controlled by servos according to the command signals received by the radio receiver.

16 Claims, 7 Drawing Figures

RADIO CONTROLLED VACUUM CLEANER

BACKGROUND OF THE INVENTION

The present invention relates to self-propelled vacuum cleaners remotely controlled by radio.

It is known to provide vacuum cleaners, for example, with an electric motor drive, and to arrange the motor drive such that the vacuum cleaner is propelled to move randomly in alternate directions and to change direction whenever an obstacle is encountered, as disclosed for example in U.S. Pat. No. 4,173,809. It is also known to remotely control self-propelled vacuum cleaners by radio, as disclosed in U.S. Pat. Nos. 4,369,543 and 4,306,329.

Self-propelled randomly moving vacuum cleaners obviously operate out of control, and the use of such vacuum cleaners presents many inconveniences as changing directions is only caused as a result of impact with walls or with furniture. Radio controlled self-propelled vacuum cleaners are generally complex in structure, require gears, dual drive motors, expensive multi-channel radio transmitter and receiver systems and complicated control systems, and often use rechargable batteries carried in the vacuum cleaner housing, which are costly, greatly increase the weight of the vacuum cleaner and require that the batteries be occasionally recharged.

SUMMARY OF THE INVENTION

The principal object of the present invention is to provide a vacuum cleaner of conventional design with a simple, sturdy and accurate remote radio control which may be incorporated into a conventional vacuum cleaner with a minimum of modification, either during manufacturing or as a retrofit on vacuum cleaners already in use. The invention utilizes state of the art radio control equipment and servo controls presently available in the market for radio controlled model airplanes, boats and automobiles, and a simple mechanical structure for providing steering and directional control of a vacuum cleaner. In addition, the present invention utilizes all the elements of a conventional vacuum cleaner, does not require complicated conversions, or heavy and costly electrical batteries to be carried by the remote control vacuum cleaner.

These and other objects of the present invention will become apparent to those skilled in the art when the following description of the best mode contemplated at the present for practicing the invention is read in conjunction with the accompanying drawing, wherein like reference numerals refer to like or equivalent parts, and in which:

DETAILED DESCRIPTION OF THE PREFERRED EMBODIMENTS

Figure 1:
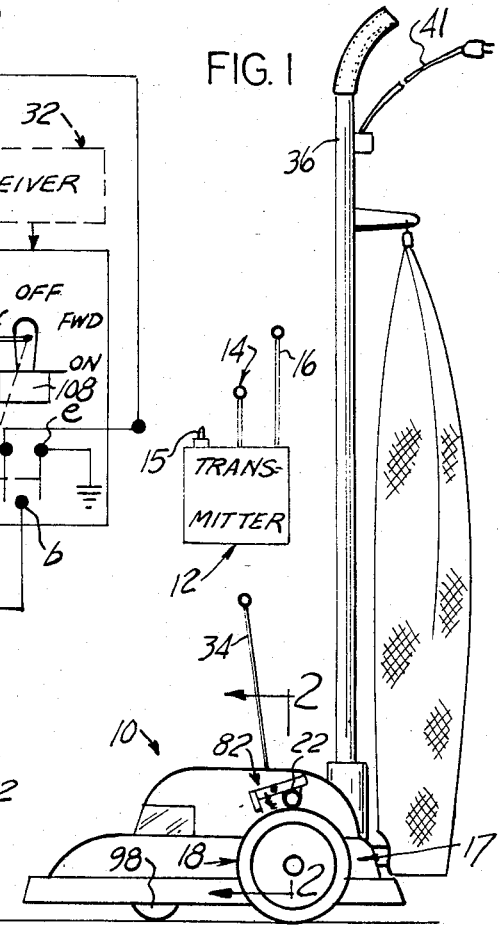
FIG. 1 is a schematic representation of a radio controlled vacuum cleaner unit according to the present invention.

Referring to the drawing and more particularly to FIG. 1, the invention comprises a conventional vacuum cleaner, for example of the upright type as shown at 10, which is remotely controlled by radio by means of a hand-held single channel transmitter 12 provided with a direction-control proportional joy stick 14 and a radiating antenna 16.

The vacuum cleaner 10 is in all respects of conventional structure, except that it is provided with an added-on or built-in remote control drive unit 17. The vacuum cleaner drive unit 17 comprises a pair of driving wheels 18 and 20, FIGS. 1 and 2, the driving wheels 18 and 20 being driven each by a drive roller, 22 and 24 respectively, each drive roller being normally in frictional engagement with the periphery of the tire, respectively 19 and 21, of the corresponding drive wheel 18 and 20. Each of the drive wheels 18 and 20 is freely rotatable by being mounted with appropriate journal bearing each on a support axle 26 bolted to a side panel 28 of an enclosure 30 installed within the housing of the vacuum cleaner 10 or attached to the housing of the vacuum cleaner in such manner as to not disturb the normal operation of the vacuum cleaner. A radio receiver 32 is installed within the compartment 30, the radio receiver 32 being provided with an antenna 34 for receiving the radio signals transmitted by the transmitter 12. The antenna 34 of the receiver 32 may be a whip antenna projecting from the housing of the vacuum cleaner 10 or, in the alternative, it may be mounted within the handle 36 of the vacuum cleaner or attached along the handle.

The radio signals received by the receiver 32 are applied to a control unit 38, which may be made integral with the housing of the receiver 32, and they selectively operate appropriate servos 40 which in turn provide appropriate electro-mechanical inputs for steering control and for directional, forward, reverse and stop, control of the vacuum cleaner 10, as will be hereinafter explained in further detail. Preferably, the radio transmitter 12 is operated from normal voltage AC power through a voltage dropping and rectifying power supply, not shown, or by DC batteries of appropriate voltage and the radio receiver 32 and control unit 38 are preferably operated from 120 volt AC power through the conventional electric cord 41 of the vacuum cleaner 10, an appropriate low voltage and DC rectifying unit, not shown, being incorporated in the system. As the radio transmitter 12 and the radio receiver 32 control unit 38 are of conventional structures well known in the art of radio control technology for model airplanes, model boats and model automobiles, and are well within the state of the art, no further description thereof will be given herein.

A reversible electric drive motor 42 is mounted in the drive and control compartment 30. The electric motor 42 is preferably a 120 volt AC or DC motor having an output shaft 44 on which is keyed a drive pulley 46 which, through a tension elastic rubber belt 48, drives a pulley 50 fastened to a driveshaft 52. As shown in the drawing, FIG. 2, one end of the driveshaft 52 is coupled to the drive roller 22 through an appropriate coupling 54 and the other end of the driveshaft 52 is coupled to the drive roller 24 through an identical coupling 54, for ease of assembly. Each of the drive rollers 22 and 24 is in the form of a stub shaft 56 journalled through a sidewall 28 of the compartment 30 of the drive unit 17 by way of an appropriate bearing 58, the outwardly projecting portion of the stub shaft 56 having a friction surface such as results from knurling the surface of the stub shaft 56 or preferably providing the stub shaft 56 with a relatively resilient friction sleeve 60, made of rubber or similar material, cemented or bonded around the periphery of the projecting end of the stub shaft 56. Alternatively, the driveshaft 52 may be made as a single-piece rigid shaft with the drive rollers 22 and 24 being integrally formed at each end of the driveshaft 52 by knurling the peripheral surface of the driveshaft end or by covering it with the friction sleeve 60.

Figure 2:
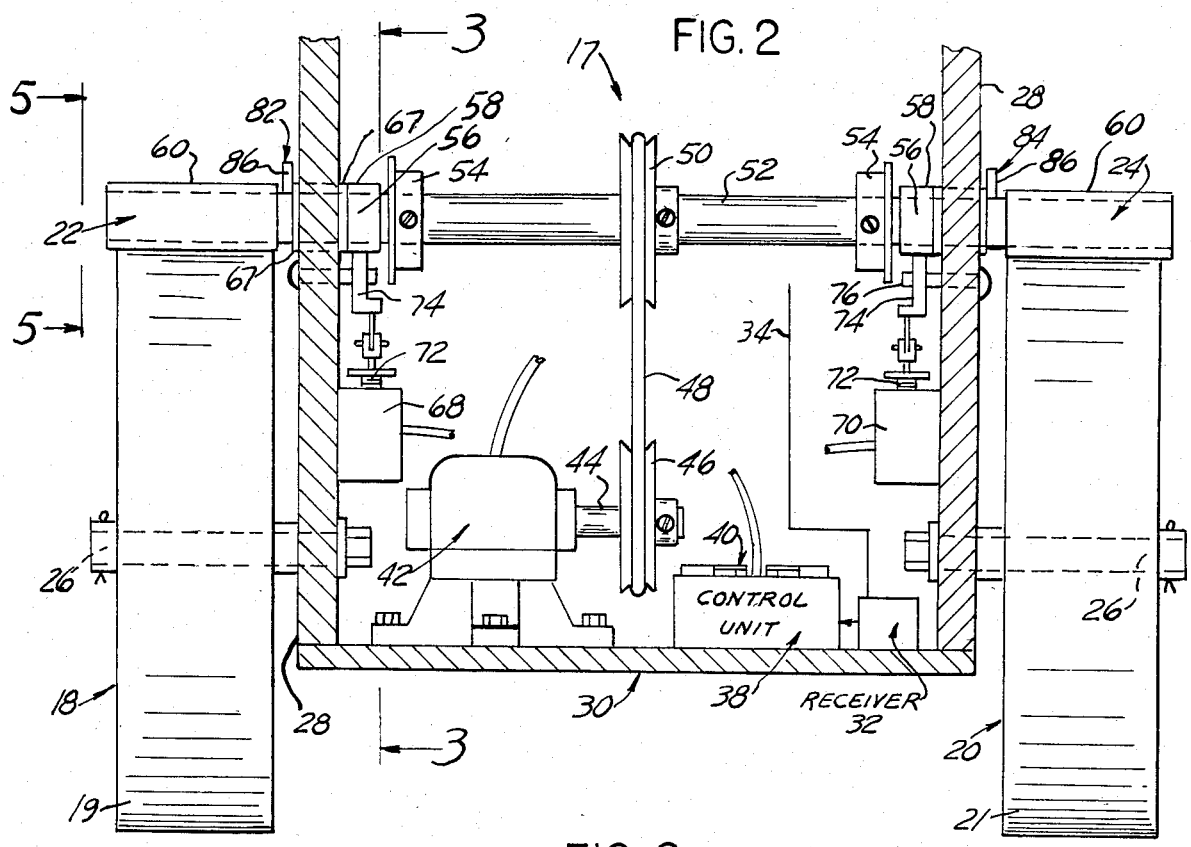
FIG. 2 is a cross-section along line 2—2 of FIG. 1.
Figure 3:
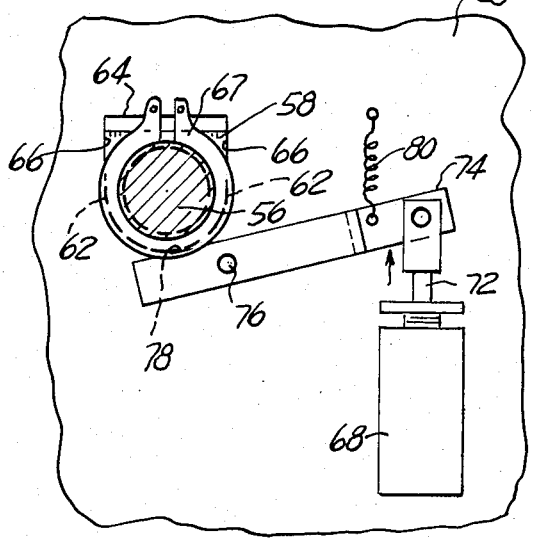
FIG. 3 is a partial section thereof from line 3—3 of FIG. 2.
Figure 4:
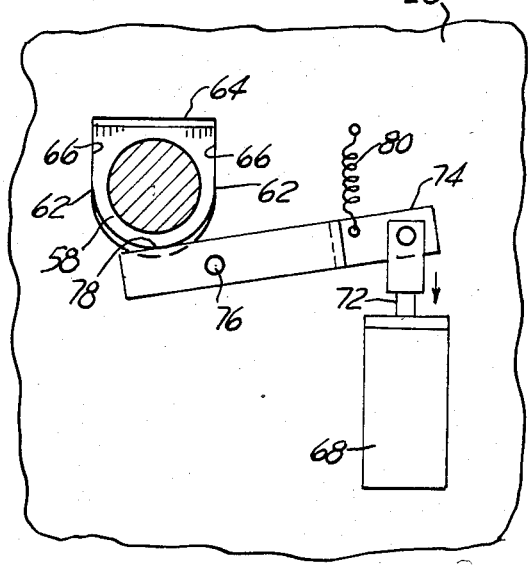
FIG. 4 is a view similar to FIG. 3, with portions omitted for the sake of clarity, illustrating the manner in which the assembly of elements of FIG. 3 operates.

As best shown at FIGS. 3 and 4, the bearing 58, which may take the form of a ball, roller, needle or plain bearing, is arranged to be upwardly movable relative to the sidewall 28, in any convenient manner. For example, and as illustrated, the bearing 58 may be provided with the shape illustrated having opposite parallel sidewalls 62 slidably fitting in an opening 64 formed in the sidewall 28 and having corresponding parallel supporting side surfaces 66 in sliding engagement with the sidewalls of the bearing 58. Means are provided for retaining each bearing 58 in the corresponding opening 64, such as, for example, a pair of spring clips 67 disposed in corresponding grooves formed in the bearing periphery, one spring clip 67 being on one side of the sidewall 28 and the other on the other side, as shown at FIGS. 2 and 3, and omitted in the other Figures for the sake of clarity. By forming the aperture 64 with a higher height than that of the bearing 58, the bearing 58, and therefore the end of the driveshaft 52 or the stub shaft 56 journalled therethrough, is capable of slight up and down linear motion. The elastic belt 48, FIG. 2, being normally under tension exert a pull on the driveshaft 52 such as to normally engage the surfaces of the drive rollers 22 and 24 with the peripheral surfaces of the tires of the drive wheels 18 and 20. Consequently, the wheels 18 and 20 are driven in rotation in one direction or the other by the drive rollers 22 and 24, respectively, when the electric motor 42 drives the driveshaft 52 in one direction or the other.

Each drive roller 22 or 24 may be selectively lifted such as to be disengaged from the peripheral surface of the tire 19 or 21 of its corresponding drive wheel 18 or 20. Lifting of the drive roller 22 from engagement with the surface of the tire 19 of the wheel 18 is effected by energizing an electrical solenoid 68, while lifting of the drive roller 24 from engagement with the surface of the tire 21 of the wheel 20 is effected by energizing a solenoid 70. Each solenoid 68 or 70 has a plunger 72 pivotably connected to the end of an arm or lever 74. The lever 74 is pivotable around a pivot pin 76 affixed to the compartment sidewall 28 and has an end surface 78 disposed proximate the bottom of the bearing 58 under the pulling action of a return spring 80. When the solenoid 68 or 70 is activated, FIG. 4, the solenoid plunger 72 is pulled within the solenoid core, and the arm 74 is pivoted around the pivot pin 76, thus engaging the end surface 78 of the lever arm 74 with the bottom of the bearing 58, in turn displacing the bearing 58 upwardly and causing disengagement of the drive roller 22 or 24, according to which of the solenoids 68 or 70 has been selectively activated, from the peripheral surface of the tire 19 or 21 of the corresponding wheel 18 or 20, thus no longer driving the wheel. When the appropriate solenoid 68 or 70 is deactivated, the corresponding drive roller 22 or 24 is returned to its driving position in engagement with the peripheral surface of the tire 19 or 21 of the corresponding wheel 18 or 20, under the biasing action of the tension rubber belt 48.

Figure 5:
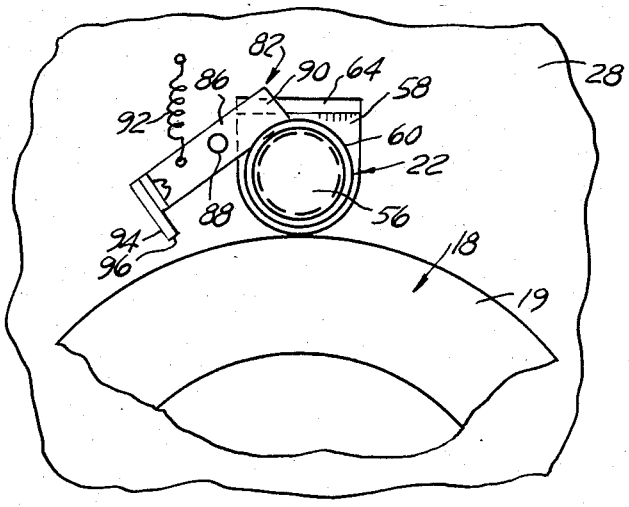
FIG. 5 is a partial view from line 5—5 of FIG. 2.

Each of the wheels 18 and 20 is provided with an individual brake unit, shown respectively at 82 and 84 at FIG. 2. As shown in detail at FIG. 5 with respect to the brake unit 82 co-operating with the drive wheel 18, each brake unit comprises a lever 86 pivotable about a pivot pin 88 relative to the compartment sidewall 28, one end 90 of the lever arm 86 being maintained, under the action of a return spring 92, in sliding engagement with the periphery of the stub shaft 56 or, alternatively, in engagement with an abutment, not shown, formed in the bearing 58. The other end of the lever 86 is formed as, or is provided with, a brake shoe or bracket 94 having a tip 96 normally spaced apart from the peripheral surface of the tire 19 of the wheel 18. When the drive roller 22 is lifted from engagement with the peripheral surface of the tire 19 of the drive wheel 18, and is thus no longer driving the wheel 18, the end 90 of the lever 86 is also lifted, thus causing the tip 96 of the brake shoe or bracket 94 to engage the peripheral surface of the tire 19 of the wheel 18, thus preventing the wheel 18 from rotating.

It will be appreciated by those skilled in the art that steering control of the radio controlled carpet sweeper or vacumm cleaner 10 is accomplished by lifting one of the drive rollers 22 or 24 from engagement with the peripheral surface of the tire 19 or 21 of the drive wheel 18 or 20, according to the direction in which it is desired to steer the vacuum cleaner 10. Simultaneously with lifting of the appropriate drive roller 22 or 24, the corresponding drive wheel 18 or 20 is immobilized by the corresponding brake unit 82 or 84, thus causing the vacuum cleaner 10 to pivot around a substantially vertical axis, for steering. The carpet sweeper or vacuum cleaner 10, FIG. 1, is generally provided with a pair of front small diameter wheels 98 which, during a turn, are simply sliding laterally over the floor surface. If so desired, the front small wheels 98 may be replaced by casterable rollers.

Figure 6:
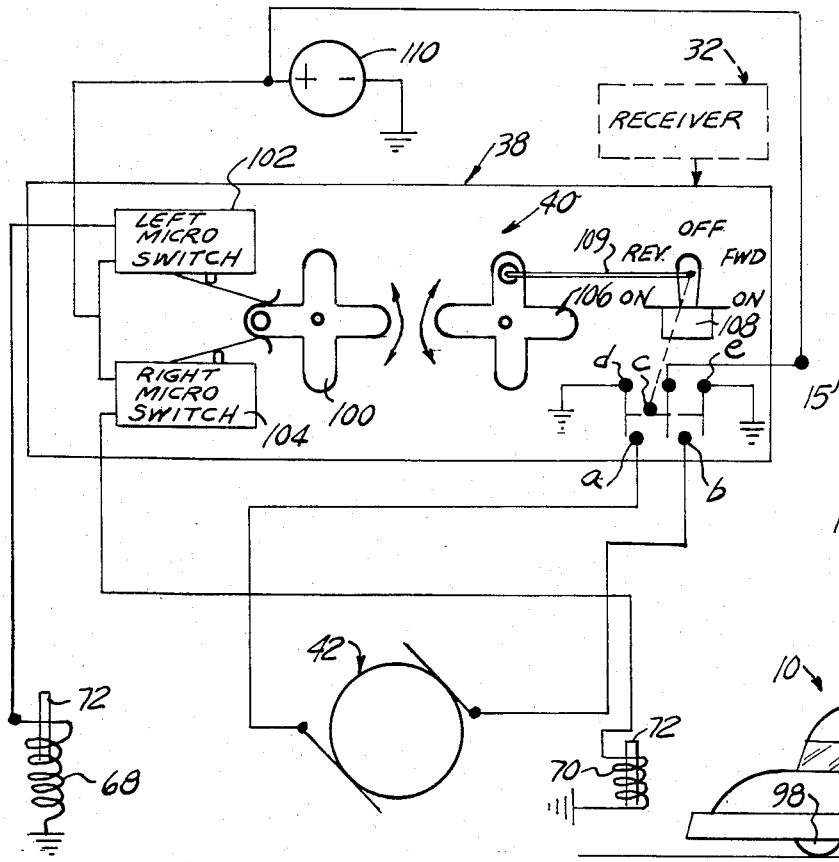
FIG. 6 is a schematic diagram of the control portion of the invention.

Forward motion and reverse motion of the vacuum cleaner 10 are effected by reversing the direction of rotation of the output shaft 44 of the drive motor 42, FIG. 2. The servo system 40 of the control unit 38, as schematically represented at FIG. 6, comprises a steering servo 100 arranged to operate either one of a pair of normally "off" micro switches 102 and 104, according to the direction of rotation of the steering servo 100, resulting from the steering command signal controlled by the joy stick 14, transmitted by the transmitter 12 and received by the receiver 32. The micro switch 102, when tripped, energizes the solenoid 68, and the micro switch 104, when tripped energizes the solenoid 70.

Turning "on" and "off" the drive motor 42 is effected by a second servo 106 connected through a link 109 to a toggle switch 108 which, in its mid-position places the toggle switch 108 in an "off" mode. Rotation of the servo 106 to one extreme position places the switch 108 to an "on" and "forward" mode, and rotation of the servo 106 to another extreme position places the switch 108 to an "on" and "reverse" mode for controlling the energizing of the motor 42 to "off", "forward" and "reverse".

The drive motor 42 may be a reversible AC motor or a reversible DC motor. When a reversible DC motor 42 is used for driving the vacuum cleaner 10, the DC motor is supplied in DC current through a rectifier, not shown, installed in the compartment 30 to the input of which AC current from the conventional home electrical outlet is supplied through the vacuum cleaner electric cord 41. The output of the rectifying unit, corresponding to the DC power supply arbitrarily represented at 110 in the schematic of FIG. 6, is connected across the reversible motor 42 through the switch 108, and across the solenoids 68 and 70 through, respectively, the micro switches 102 and 104. With both micro switches 102 and 104 "off", under the control of the servo 100, and the directional switch 108 in its "off" position, the vacuum cleaner 10 is standing still. The switch 108 has a pair of terminals a and b connected across the motor 42 and a terminal c provided with a movable contact connected to one terminal of the power supply 110. Return of current to the power supply from the switch 108 is effected by way of two other terminals d and e each provided with a movable contact. In the position of the movable contacts or terminals c, d and e of the switch 108 illustrated at FIG. 6, the circuit is open and no electrical current is supplied to the electric motor 42. When a "forward" command signal is transmitted by the transmitter 12 of FIG. 1 and received by the receiver 32, the servo 106 actuates the switch 108 to connect the switch terminal a with the switch terminal c and simultaneously the switch terminal e with the switch terminal b, with the result that electrical current is caused to flow through the motor 42 in the appropriate direction causing forward motion of the vacuum cleaner 10. When a "reverse" command signal is received by the receiver 32, the servo 106 is caused to rotate to a position that causes the switch terminal c to be connected with the switch terminal b and the switch terminal d to be connected with the switch terminal a, causing a current, in the reverse direction, to flow through the motor 42, thus reversing the direction of rotation of the motor 42.

When using an AC drive motor 42, the operation of the servo 106 is the same as hereinbefore explained, for operating the on/off and reversing switch 108. Preferably, the reversing switch 108 takes the form of a relay, as is well known in the art.

When, during forward motion of the vacuum cleaner 10 for example a right turn signal is transmitted by the transmitter 12, as a result of operation of the joy stick 14 to the right, rotation of the servo 100 from its neutral position, as illustrated, to an appropriate angular position tripping the micro switch 104 causes electrical current to flow through the solenoid 70. The drive roller 24, FIG. 2, is lifted out of engagement with the peripheral surface of the tire 21 of the wheel 20, and lifting of the drive roller 24 simultaneously energizes the brake unit 84 such as to immobilize the drive wheel 20. Therefore, as the drive wheel 19 continues to be driven by the drive roller 22 in engagement with the peripheral surface of the tire 19, a turn to the right is effected by the vacuum cleaner. To effectuate a turn to the left, the joy stick 14 of the transmitter 12 is actuated in the appropriate direction such as to send a left turn command signal which is received by the receiver 32 to control the servo 100 in the appropriate direction that closes the micro switch, 102, thus energizing the solenoid 68 and lifting the drive roller 22 from engagement with the peripheral surface of the tire 19 of the drive wheel 18, while simultaneously engaging the brake unit 82.

Figure 7:
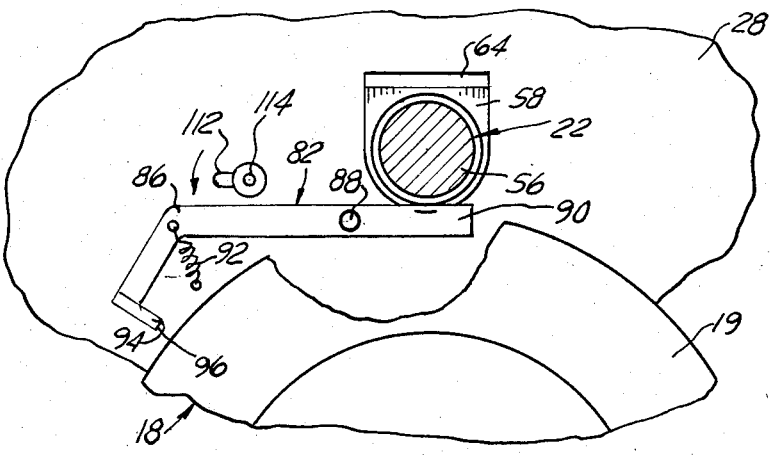
FIG. 7 is a view similar to FIG. 5 but showing a modification thereof.

Manual operation of the vacuum cleaner is possible by lifting the rear portion of the vacuum cleaner such as to lift the drive wheels 18 and 20 from the ground and displacing the vacuum cleaner by means of the front wheels 98, for example for storage in a closet. However, if continuous manual use of the vacuum cleaner is desired, this may be effected by disconnecting the tension belt 48, by slipping it off from the pulleys 50 and 46, FIG. 2, or by lifting the driveshaft 52 by way of simple levers. Alternately, and preferably, the drive rollers 22 and 24 may be lifted from engagement with the respective drive wheel tires 19 and 21 by means of manually operated levers or cams. The braking units 82 and 84 can be used for that purpose. An illustration of an example of such modification is shown at FIG. 7, much modification allowing the brake levers 86 to act as manually operated levers for lifting the drive rollers 22 and 24 to an intermediary position, disengaging the surface of each roller 22 and 24 from the peripheral surface of each of the drive wheel tires 19 and 21 and not engaging the tip 96 of the brake shoe bracket 94 with the peripheral surface of the corresponding tire. In the example of structure of FIG. 7, the brake units 82 and 84 are mounted inverted, i.e. with the end 90 of the lever arm 86 in engagement with the bottom, rather than the top, of the stub shaft 56. During normal steering operation, the engagement of the tip 96 of the brake shoe bracket 94 with the peripheral surface of the tire 19 or 21 is effected under the action of the spring 92, when the stub shaft 56 is lifted under the control of the solenoid 68 or 70. To place the lever arm 86 in an intermediary position permitting free rolling of the drive wheel 18 and 20, a cam 112 rotatably attached to the sidewall 28 is manually rotated, for example by means of a knob 114, to a position engaging the tip of the cam 112 with the side surface of the lever arm 86 such as to pivot the lever arm 86 to a position lifting the stub shaft 56, or alternatively the end of the driveshaft 52 upwardly of an appropriate distance disengaging the drive roller 22 from the peripheral surface of the tire 19, and still maintaining the tip 96 of the brake shoe bracket 94 spaced apart from the peripheral surface of the tire.

It will be appreciated by those skilled in the art that the structures herein described and illustrated represent only examples of structure well designed for practicing the invention, given for illustrative purpose only, and that modifications whereof will be apparent to those skilled in the art.

What is desired to be secured by Letters Patent is as follows:

1. A remote-radio controlled vacuum cleaner comprising a conventional vacuum cleaner having a body, radio signals transmitting means, radio signals receiving means mounted in said body, a pair of ground engaging wheels each mounted on a side of said body, a driveshaft extending transversely through said body and having at each end a drive roller in frictional engagement with the periphery of one of said wheels, reversible electric motor drive means in said body for driving said driveshaft, and means for selectively disengaging one of said drive rollers from the periphery of a corresponding wheel upon said radio receiver receiving a steering control command signal, means for reversing the direction of drive of said electrical motor upon said radio receiver receiving an appropriate directional command signal, and means for allowing each said drive roller to be manually lifted from the periphery of each of said wheels for manual operation of said vacuum cleaner.

2. The vacuum cleaner of claim 1 further comprising brake means simultaneously operated by said means disengaging one of said drive rollers from the periphery of a corresponding wheel.

3. The vacuum cleaner of claim 2 wherein said drive means driving said driveshaft from said drive motor comprises a first pulley mounted on said driveshaft, a second pulley mounted on an output shaft of said motor, and an elastic belt coupling said first pulley to said second pulley.

4. The vacuum cleaner of claim 3 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

5. The vacuum cleaner of claim 4 wherein said brake means comprises a lever arm having an end engaged with said driveshaft proximate said drive roller and a brake shoe mounted on the other end of said lever arm, said brake shoe being normally positioned in proximity with the periphery of said wheel, whereby displacement of said driveshaft for disengaging said drive roller from said periphery of said wheel causes engagement of said brake shoe with the periphery of said wheel.

6. The vacuum cleaner of claim 3 wherein said brake means comprises a lever arm having an end engaged with said driveshaft proximate said drive roller and a brake shoe mounted on the other end of said lever arm, said brake shoe being normally positioned in proximity with the periphery of said wheel, whereby displacement of said driveshaft for disengaging said drive roller from said periphery of said wheel causes engagement of said brake shoe with the periphery of said wheel.

7. The vacuum cleaner of claim 2 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

8. The vacuum cleaner of claim 7 wherein said brake means comprises a lever arm having an end engaged with said driveshaft proximate said drive roller and a brake shoe mounted on the other end of said lever arm, said brake shoe being normally positioned in proximity with the periphery of said wheel, whereby displacement of said driveshaft for disengaging said drive roller from said periphery of said wheel causes engagement of said brake shoe with the periphery of said wheel.

9. The vacuum cleaner of claim 2 wherein said brake means comprises a lever arm having an end engaged with said driveshaft proximate said drive roller and a brake shoe mounted on the other end of said lever arm, said brake shoe being normally positioned in proximity, with the periphery of said wheel, whereby displacement of said driveshaft for disengaging said drive roller from said periphery of said wheel causes engagement of said brake shoe with the periphery of said wheel.

10. The vacuum cleaner of claim 1 wherein said drive means driving said driveshaft from said drive motor comprises a first pulley mounted on said driveshaft, a second pulley mounted on an output shaft of said motor, and an elastic belt coupling said first pulley to said second pulley.

11. The vacuum cleaner of claim 10 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

12. The vacuum cleaner of claim 1 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

13. A remote-radio controlled vacuum cleaner comprising a conventional vacuum cleaner having a body, radio signals transmitting means, radio signals receiving means mounted in said body, a pair of ground engaging wheels each mounted on a side of said body, a driveshaft extending transversely through said body and having at each end a drive roller in frictional engagement with the periphery of one of said wheels, reversible electric motor drive means in said body for driving said driveshaft, and means for selectively disengaging one of said drive rollers from the periphery of a corresponding wheel upon said radio receiver receiving a steering control command signal, means for reversing the direction of drive of said electrical motor upon said radio receiver receiving an appropriate directional command signal, and brake means simultaneously operated by said means disengaging one of said drive rollers from the periphery of a corresponding wheel, wherein said brake means comprises a lever arm having an end engaged with said driveshaft proximate said drive roller and a brake shoe mounted on the other end of said lever arm, said brake shoe being normally positioned in proximity with the periphery of said wheel, whereby displacement of said driveshaft for disengaging said drive roller from said periphery of said wheel causes engagement of said brake shoe with the periphery of said wheel.

14. The vacuum cleaner of claim 13 wherein said drive means driving said driveshaft from said drive motor comprises a first pulley mounted on said driveshaft, a second pulley mounted on an output shaft of said motor, and an elastic belt coupling said first pulley to said second pulley.

15. The vacuum cleaner of claim 14 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

16. The vacuum cleaner of claim 13 wherein said means for selectively disengaging one of said drive rollers from the periphery of a corresponding wheel comprises a pair of lever arms each arranged to lift an appropriate end of said driveshaft for disengaging said drive roller on said end from the periphery of the corresponding wheel, and a pair of electrical solenoids each having an output member connected to one of said lever arms for actuating said one of said lever arms.

* * * * *